US005242464A

United States Patent [19]

Armstrong et al.

[11] Patent Number: 5,242,464

[45] Date of Patent: Sep. 7, 1993

[54] METHOD OF BLEACHING WOOD

[75] Inventors: Donn R. Armstrong, Lisle; Richard P. Anderson, Claredon Hills; Stanley S. Borys, Naperville, all of Ill.

[73] Assignee: Pyxis Corporation, Elmhurst, Ill.

[21] Appl. No.: 689,297

[22] Filed: Apr. 22, 1991

[51] Int. Cl.[5] ..... D06P 3/60

[52] U.S. Cl. ..... 8/402; 8/111

[58] Field of Search ..... 8/402, 111, 931

[56] References Cited

U.S. PATENT DOCUMENTS

| | | | |
|---|---|---|---|
| 1,068,580 | 7/1913 | Frank-Philipson | 8/111 |
| 1,251,614 | 1/1918 | Anders | 8/111 |
| 2,096,400 | 10/1937 | Kritchevsky | 8/111 |
| 2,312,218 | 2/1943 | MacBean | 8/111 |
| 2,397,193 | 3/1946 | Miller | 8/111 |
| 2,733,119 | 1/1956 | Nack | 8/402 |
| 2,867,493 | 1/1959 | Nack | 8/402 |
| 5,034,096 | 7/1991 | Hammer et al. | 162/65 |

FOREIGN PATENT DOCUMENTS

| | | | |
|---|---|---|---|
| 142802 | 8/1983 | Japan | 8/402 |
| 149955 | 9/1983 | Japan | 8/402 |

OTHER PUBLICATIONS

Kirk-Othmer Encyclopedia of Chemical Technology, 3rd ed., vol. 13, p. 14, (1981).

*Primary Examiner*—Prince Willis, Jr.
*Assistant Examiner*—Alan D. Diamond

[57] ABSTRACT

This invention relates to a method for a single application of wood bleach that improves the degree of whiteness, uniformity and depth of bleaching in the wood. The method includes the application of sufficient quantities of wood bleach to maintain an excess of liquid on the surface of wood for an extended time such as a minimum of 10 minutes to obtain penetration to a greater depth. Periodic motion of an abrasive powder, or an abrasive pad to continually relocate the excess bleach on the wood surface, either by machine or by hand, provides even distribution and eliminates the raised grain on the bleached wood. Another aspect to the invention is a single step process of bleaching and dyeing in which the dye is mixed in the bleach solution.

13 Claims, No Drawings

METHOD OF BLEACHING WOOD

BACKGROUND OF THE INVENTION

The invention relates to a method of applying bleaching solution to a wood surface to reduce the natural color of the wood as a final process or as part of a procedure using dyes to impart an artificial color to the wood.

DESCRIPTION OF PRIOR ART

One important method of bleaching wood is to apply a solution of hydrogen peroxide to the surface of the wood. For effective bleaching action, the pH of the hydrogen peroxide solution is raised above its normal to greater than 9. This is normally done by using a second, basic solution usually containing sodium hydroxide and a stabilizing compound. Two methods of application are in common use:

1. The basic solution is first spread on the wood surface and allowed to partially or completely dry. Then the hydrogen peroxide solution is spread on the wood and wiped off.

2. The basic solution is mixed with the hydrogen peroxide solution, and the mixture is immediately spread on the wood surface, and then wiped off.

In both methods the application is repeated until no discernible lightening of the wood color occurs. As the bleaching action is prolonged on normal wood surfaces, several hours wait may be required before the degree of bleaching can be determined. The wood is then allowed to dry thoroughly and lightly sanded to remove some of the grain raised by the application of the solutions.

Much of the time spent on these methods of bleaching wood are an inherent part of their trial and error nature. Although the goal of the bleaching is to provide the greatest reduction in natural color, the processes require multiple attempts until no further improvement is seen.

OBJECT OF INVENTION

A principle object of the current invention is to provide a method of applying hydrogen peroxide bleach in a way that assures the maximum apparent bleaching action in a single application so that multiple applications and inspections are unnecessary. The method comprises spreading a freshly mixed basic solution of hydrogen peroxide and sodium hydroxide onto a wood surface and keeping the surface moist with the solution for a minimum length of time. Another principle object of the invention is the option of using continual abrasion while the wood is moist with the bleach solution to provide an enhanced uniformity of the bleach application and a reduction in the natural grain swelling as the wood dries. This reduces and may eliminate the need for post application sanding of the dry wood. A third principle object of the invention is the option of mixing water soluble dyes into the bleach solution and achieving a single step bleach and coloration of the wood surface. Suitable dyes must both be stable in the strongly oxidizing environment of the bleach solution and not promote the breakdown of the active peroxide bleach.

SUMMARY OF INVENTION

The method of this invention for bleaching wood surfaces comprises the application of a freshly mixed bleaching solution of hydrogen peroxide, for example (15–50%) and sodium hydroxide such as (2–10%) and preferably a compound that serves to prevent the decomposition of the hydrogen peroxide, and keeping the wood surface moist (a visible layer of solution on the surface of the wood) applied for a minimum period of 10 minutes, preferable approximately 15 minutes. It preferably also includes the continual abrasion of the moist wood surface during the time period. At the end of the period, the solution may be removed or left in place to dry. An option is the addition of a dye to the mixed bleach solution to simultaneously bleach and color the wood surface.

DESCRIPTION OF THE INVENTION WITH ILLUSTRATIVE EXAMPLES

The method of this invention allows a single application of wood bleach and a single application of wood finish. Significant improvements in the degree of whiteness, uniformity and depth of bleach layer can be obtained for all two part (sodium hydroxide and hydrogen peroxide type) wood bleaches with the described techniques of application.

Prior application techniques require multiple applications of bleaching solution with long (24–48 hour) drying times between application to attain a comparable degree of whiteness. Prior application techniques bleach the wood in only a very narrow layer on the surface, with the result that sanding of the surface directly could not be done without risk of removing the bleached layer. Such application techniques also require multiple applications of wood finishes (varnish, shellac, etc.) with sanding between applications to remove the raised grain.

With the method of this invention, a single application of wood bleach can be made and the highest degree of whiteness, uniformity and depth of penetration possible will be attained. Double-blind matrices of tests demonstrated that although some differences in the performance of various wood bleaches were apparent, all two part wood bleaches performed better when the method of this invention was used to apply the bleach.

We discovered that maintaining a wood bleach solution comprising sodium hydroxide and hydrogen peroxide on a wood surface for a minimum period of time of 10 minutes produced as complete a bleach appearance as obtained by the multiple applications of prior art. Approximately 15 minutes of solution on the wood surface gave the whitest and most uniform surface. Maintaining excess solution on the surface of the wood for times longer than 15 minutes does not particularly improve the whiteness or uniformity although it can be done and in some instances it is helpful. Maintaining excess solution on the surface of the wood for times less than 10 minutes generally decreases the whiteness of the final color.

To insure that the bleach solution remains active for the full time period a well stabilized bleach is advisable. The addition to the bleach solution of a hydrogen peroxide stabilizer is important and gives the best results.

We investigated a variety of techniques to maintain an excess of bleach solution on the surface of the wood. To achieve uniform penetration, movement of the excess solution back and forth over the surface is required. Rubbing the wood having the bleach solution thereon with an abrasive such as emery powder, pumice or the like, at the interface between the wood surface and the bleach is desirable. For large horizontal surfaces, using a rotary floor buffer with an abrasive pad to "work" the wood bleach solution back and forth over the surface provides the benefit that the raised wood grain is abraded off, leaving a smooth surface that can be finished with a single coat of varnish, shellac, or other wood finish. For other surfaces, such as smaller surfaces or vertical or inclined surfaces, application can be performed by hand, using an abrasive pad with gentle pressure.

A composition of two parts of bleach which has been found to be satisfactory in the method of this invention is:

sodium hydroxide 2%
sodium silicate 1%
sodium borate 1%
hydrogen peroxide 15%

Other basic two part compositions known to the art for bleaching wood may be used. Stabilizers to retard decomposition of hydrogen peroxide other than sodium silicate or sodium borate may be used, such a magnesia sulfate, sodium phosphate, sodium ethylenediamine tetraacetate and other known in the art. The amount of stabilizer used is such that it will maintain the hydrogen peroxide active for the time period. This amount is generally at least 1% of the bleach solution. The proper amount can be readily determined experimentally.

The invention is useful for all types of wood that have a bleachable coloration such a heartwood, sapwood, etc. and can be used to bleach wood flooring, wood cabinets and other wood surfaces.

The invention is also useful in a one-step process of bleaching and dyeing.

The addition of certain dyes to the two part bleach composition that are stable in the peroxide solution and that do not catalyze the breakdown of the hydrogen peroxide will allow the simultaneous coloration and bleaching of the wood. The addition of stabilizers such as sodium silicate, or up to 0.05% of a chelating agent such as sodium ethylenediamine tetraacetate to the bleach solution are helpful to prevent breakdown of the hydrogen peroxide by the dye.

Dyes that have been found suitable for this use include:

| | |
|---|---|
| Acid Black | 52, 194 |
| Acid Blue | 229, 254, 260 |
| Acid Red | 407 |
| Acid Yellow | 220 |
| Direct Black | 80 |
| Direct Violet | 104 |
| Direct Yellow | 11, 28 |

Other dyes are known to the art which have the above properties or can be determined by sample tests can also be used.

Added Examples for Bleach Application Techniques

1. Prepare Bleach

Mix two part bleach 1 to 1 by volume in a non-metal (plastic or ceramic) container within 20 minutes of use. One part to consist of 20–30% H202 (hydrogen peroxide) with stabilizers. The other part to contain 4–6% by weight of NaOH (sodium hydroxide) with stabilizers as shown above.

2. Apply Bleach

Apply the bleach mixture to clean, bare wood surface in sufficient quantity to form a continuous liquid layer on the wood surface (400 ml/square meter).

3. Maintain Bleach

Maintain the layer for at least 10 minutes. If it starts to dry out or become adsorbed, add more bleach to keep a continuous liquid layer.

4. Agitate Bleach

Agitate the bleach layer during the 10 minute time period with a 150 grit abrasive pad on a low rpm sanding machine. Keep the machine in continuous motion uniformly over the wood surface.

5. Add Color

To color the wood surface in the same step as the bleaching, add any of the dyes listed above at concentrations up to 0.2% by weight to the bleach mixture before applying it to the wood surface.

The following is a description of our tests and test results which show the value of the invention and gives specific results obtained. This is a supplement of the above disclosure.

The test matrix was set up to study the effect of application techniques on the degree of bleaching produced by applying a two part wood bleach mixture to a wood surface. For each test a short piece of 2¼" wide oak flooring was selected on the basis of consistent grain and initial wood color. The surface of each test piece was subdivided into four equal segments by a cross of ⅛" wide tape. Bleach was applied differently to each of the four segments. When a number of these test pieces had been prepared, the tapes were removed and the individual segments judged for whitness in a double blind test. This experimental approach was used to measure the effect of changing one application variable at a time.

One series of tests measured the effect of the quantity of bleach that was applied to each surface segment. The test series showed that standard recommended practice in the industry was to use too little bleach; increasing the bleach concentration per surface area produced a whiter surface, up to a saturation level.

A second series of tests measured the effects of varying the contact time between the bleach and the wood surface. Current recommendations call for applying the bleach and immediately wiping it off. In our tests we maintained a sufficiency of bleach (as measured in the above tests) on the wood surface for varying lengths of time. We found that bleaching action continued for 10 to 15 minutes. At the end of that period the wood would be bleached to its equilibrium whiteness, that is additional applications would produce no additional whitening. We tested this conclusion by bleaching pieces of wood, then rebleaching segments of the same pieces and judging the whiteness in a double blind test. One application with sufficient bleach for a long enough period of time would bleach wood to its equilibrium color; currently recommended bleach application techniques require a number of applications to reach the same condition.

An additional benefit to our recommended application technique is the penetration depth of the bleach layer into the wood. Our technique produces a deeper bleach layer thus allowing the wood grain which is raised by the contact with the aqueous bleach solution to be lightly machine sanded. Other techniques produce such a thin layer that the surfaces have to be carefully hand sanded or varnished first and then sanded down.

The whole process of sanding down the raised grain can be bypassed if the bleach is recirculated during the bleaching process with a mild abrasive pad. The idea of maintaining an even bleach distribution with an abrasive pad (our second principle object) produces two benefits—prevention of bleach deficient areas from forming a dark spot on the wood surface and removing the raised grain during the bleach process. To test the raised grain conclusion, large wood surfaces were bleached (using our recommended bleach concentration and recommended time) with and without bleach circulation using machine driven rotary abrasive pads. Reduction in raised grain in the tests with rotary pads was strikingly obvious.

If water soluble dyes are mixed into the bleach solution before application to the wood surface, the wood can be bleached and dyed in a single step—our third principle object. Using our recommended application techniques (both the recommended time and concentration as well as dispersion with an abrasive) the system can produce an evenly dyed wood surface in a wide range of colors. However, most dyes interact with the bleach so either the dyeing action or the bleaching action will be destroyed. Many dye-bleach combinations were tested on wood surfaces to ensure the stability of dye in the bleach. Combinations that did not degrade the dyeing action were then tested for bleach stability by measuring the adiabatic temperature increase of the bleach-dye mixture held in a vacuum dewar; successful bleach-dye combinations remained stable (no runaway temperature reaction) for at least one hour. Some of the dyes that met both stability criteria are listed above.

What is claimed is:

1. A method of bleaching and dyeing a wood surface which, sodium hydroxide comprises the steps of; applying a solution comprising hydrogen peroxide and a dye to the surface of the wood, and maintaining the solution to the surface for a period of time of at least 10 minutes.

2. A method in accordance with claim 1 in which the time is approximately 15 minutes.

3. A method in accordance with claim 1 in which an abrasive is moved on the wood at the interface between the wood surface and the solution while the solution is maintained on the wood surface.

4. A method in accordance with claim 3 in which the abrasive is applied by moving an abrasive pad back and forth on the wood surface to relocate continually excess solution on the wood surface.

5. A method in accordance with claim 4 in which the time is approximately 15 minutes.

6. A method in accordance with claim 1 in which said solution contains an effective amount of hydrogen peroxide stabilizer to prevent decomposition of the hydrogen peroxide during the time period.

7. A method in accordance with claim 1 in which said dye is stable in hydrogen peroxide.

8. A method in accordance with claim 7 in which said solution contains up to 0.05% of sodium ethylenediamine tetraacetate.

9. A method in accordance with claim 1 in which said solution contains an effective amount of hydrogen peroxide stabilizer to prevent decomposition of the hydrogen peroxide during the time period, said dye is stable in hydrogen peroxide and contains up to 0.05% of sodium ethylenediamine tetraacetate, and wherein an abrasive is moved on the wood surface at the interface between the wood surface and the solution while the solution is maintained on the wood surface by moving an abrasive pad back and forth on the wood surface to relocate continually excess solution on the wood surface, and the time period is approximately 15 minutes.

10. A method of simultaneously bleaching and dyeing a wood surface which comprises the steps of: applying a solution comprising a dye, hydrogen peroxide and sodium hydroxide to the surface of the wood sufficient to thoroughly wet the surface, maintaining excess solution on the surface for a period of time of at least 10 minutes, and continuously redistributing the excess solution on the surface by rubbing with an abrasive pad; thereby providing a one-step process for the simultaneous bleaching and dyeing of wood surfaces and yielding a surface having a reduction in raised grain.

11. A method in accordance with claim 10 wherein said solution further comprises sodium silicate, sodium borate, and sodium ethylenediamine tetraacetate.

12. A method of bleaching a wood surface which comprises the steps of: applying a solution comprising hydrogen peroxide and sodium hydroxide to the surface of the wood sufficient to thoroughly wet the surface, maintaining excess solution on the surface for a period of time of at least 10 minutes, and continuously redistributing the excess solution on the surface by rubbing with an abrasive pad; thereby providing a one-step process for the bleaching of wood surfaces and yielding a surface having a reduction in raised grain.

13. A method in accordance with claim 12 wherein said solution further comprises sodium silicate, sodium borate, and sodium ethylenediamine tetraacetate.

* * * * *